US007951099B2

(12) United States Patent
Ishiguro et al.

(10) Patent No.: US 7,951,099 B2
(45) **Date of Patent: *May 31, 2011**

(54) MASSAGE DEVICE

(75) Inventors: Fumitaka Ishiguro, Shizuoka (JP); Tetsuya Ishikawa, Shizuoka (JP)

(73) Assignee: Marutakatechno Co., Ltd., Shizuoka (JP)

( * ) Notice: Subject to any disclaimer, the term of this patent is extended or adjusted under 35 U.S.C. 154(b) by 865 days.

This patent is subject to a terminal disclaimer.

(21) Appl. No.: 11/941,184

(22) Filed: Nov. 16, 2007

(65) Prior Publication Data

US 2008/0103420 A1 May 1, 2008

Related U.S. Application Data

(62) Division of application No. 10/748,324, filed on Dec. 30, 2003, now Pat. No. 7,311,684.

(30) Foreign Application Priority Data

Sep. 12, 2003 (JP) ..... 2003-321908

(51) Int. Cl.
*A61H 7/00* (2006.01)

(52) U.S. Cl. ..... 601/90; 601/93; 601/94

(58) Field of Classification Search ..... 601/27–32, 601/84–87, 89, 90, 93–95, 97–99, 101–104, 601/112–115, 118, 122, 126, 133, 134, 136
See application file for complete search history.

(56) References Cited

U.S. PATENT DOCUMENTS

| | | | |
|---|---|---|---|
| 6,599,261 | B1 | 7/2003 | Chen |
| 6,969,361 | B2 | 11/2005 | Hsieh |
| 7,147,611 | B2 | 12/2006 | Kassel et al. |
| 2004/0186399 | A1 | 9/2004 | Tseng |

*Primary Examiner* — Quang D Thanh
(74) *Attorney, Agent, or Firm* — Thomas | Kayden

(57) ABSTRACT

A massage device. The massage device includes a pair of therapeutic elements and a bottom therapeutic member. The therapeutic elements are rotated by a driving shaft, driven by a driving mechanism, for supporting and massaging feet. The bottom therapeutic member is disposed between two therapeutic elements, supporting the instep of a foot. The therapeutic elements are formed along the instep.

5 Claims, 18 Drawing Sheets

MASSAGE DEVICE

CROSS REFERENCE TO RELATED APPILCATIONS

This application is a Divisional of pending U.S. patent application Ser. No. 10/748,324, filed Dec. 30, 2003 and entitled "MASSAGE DEVICE," incorporated herein by reference.

BACKGROUND OF THE INVENTION

1. Field of the Invention

The present invention relates to a massage device, and in particular to a massage device for massaging and stimulating the sole of the foot.

2. Description of the Related Art

In a conventional massage device disclosed by Japan patent No. 2001-224648, in order to provide foot massage and stimulation, an outer periphery thereof is protruded at an acute angle. A plurality of therapeutic rollers with circular, rigid arc-shaped elements having a radius of curvature of 10 mm to 15 mm are supported by rotating shafts. A locus of rotary motion of the rotating shafts is determined by uniquely shaped members. Each rotating shaft has a row of the therapeutic rollers provided thereon. A row of therapeutic rollers represents a therapeutic roller group, each row having cross sections according to the shape of the outer periphery of the uniquely shaped members. The rotating shafts move along the outer periphery of the uniquely shaped members. The shape of the outer periphery of the uniquely shaped members forms the locus of the motion of the rotating shafts. As a result, if the shape of the outer periphery of the uniquely shaped members conforms to the shape of a user's ankle and foot arch, the massage device unevenly stimulates the bottom of toes and foot arch of the entire sole of the foot when placed thereon.

The conventional massage device stimulates the entire sole of the foot by upward force. Each foot, however, tends to move upward accordingly during massage. Thus, maintaining the position of a foot on the massage device and applying weight thereon provides uneven stimulation.

Hence, there is a need for a massage device providing effective foot massage and relatively better stimulation than the conventional massage device.

SUMMARY OF THE INVENTION

Thus, an object of the invention is to provide a massage device for effective foot massage and relatively better stimulation.

The present invention provides a massage device including a pair of therapeutic elements (or massaging elements) and a bottom therapeutic member. The therapeutic elements are rotated by a driving shaft, driven by a driving mechanism, to support and massage feet. The bottom therapeutic member is disposed between two therapeutic elements, for supporting an instep of a foot. The therapeutic elements are formed along an instep of a foot. Since the therapeutic elements are formed along the instep, the load is increased, and stimulation on the sole of the foot can be intensified, further preventing the foot from upward movement resulting in the foot slipping off the device. Thus, the present invention provides effective foot massage.

The present invention further has a protrusion disposed on a side of the therapeutic elements, facing the instep of a foot, abutted from above by the protrusion for massaging. Since the protrusion faces the instep of a foot on the therapeutic elements, the protrusion presses the instep from above. When the foot is massaged from above by the protrusion, the foot is prevented from slipping upward and off the device, while maintaining optimal foot position, effectively stimulating the foot.

At least two of the therapeutic elements are disposed along the longitudinal direction of the foot. Thus, the present invention can effectively massage the foot, according to shape.

The protrusion is an airbag. Accordingly, the protrusion corresponds to the foot in both shape and size, uniformly applying pressure over the entire foot. The airbag can be expanded, thus, decreasing the distance between two therapeutic elements, thereby restricting the foot, and providing an adequate massaging pressure. Furthermore, when the pressure of the airbag is greater than a certain value, the mechanical valve discharges excess compressed air for safety, thus, controlling stimulation and increasing durability.

The bottom therapeutic member has a roller, having a protrusion facing the sole of foot. Friction on the sole of the foot is reduced by the roller, providing adequate stimulation.

The bottom therapeutic member has a seat, having a protrusion facing and protruding against the sole of the foot. The protrusion of the seat applies adequate pressure on the sole of the foot, the feeling of which may be considered pleasurable.

The bottom therapeutic member has a protrusion, freely movable between a protruded position and a submerged position facing the sole of the foot of the patient. The protrusion of the bottom therapeutic member applies adequate pressure on the reflex points (acupressure points) on the foot, which may be considered therapeutic.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
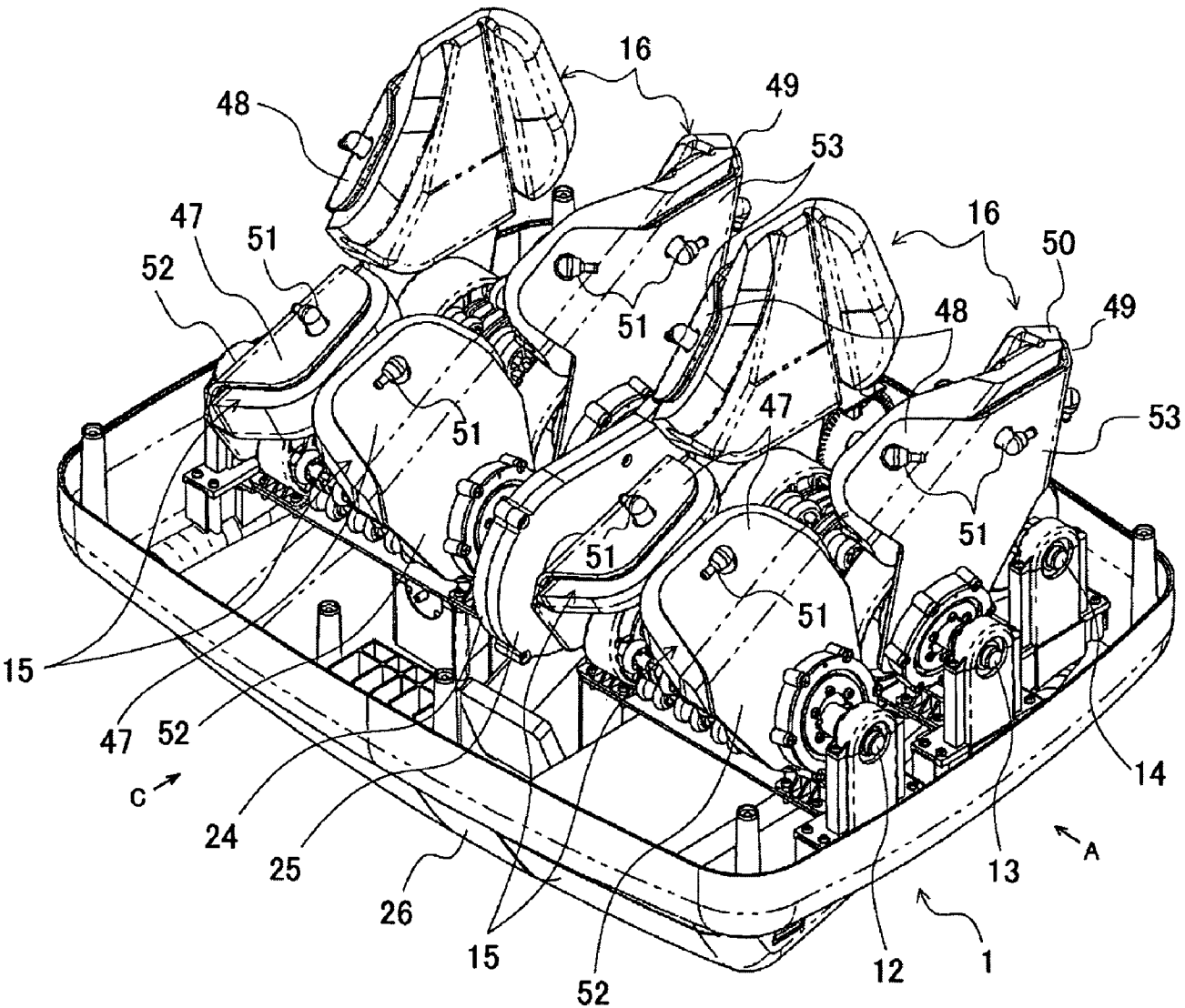
FIG. 1 is a perspective view of a massage device according to a first embodiment of the present invention.
Figure 2:
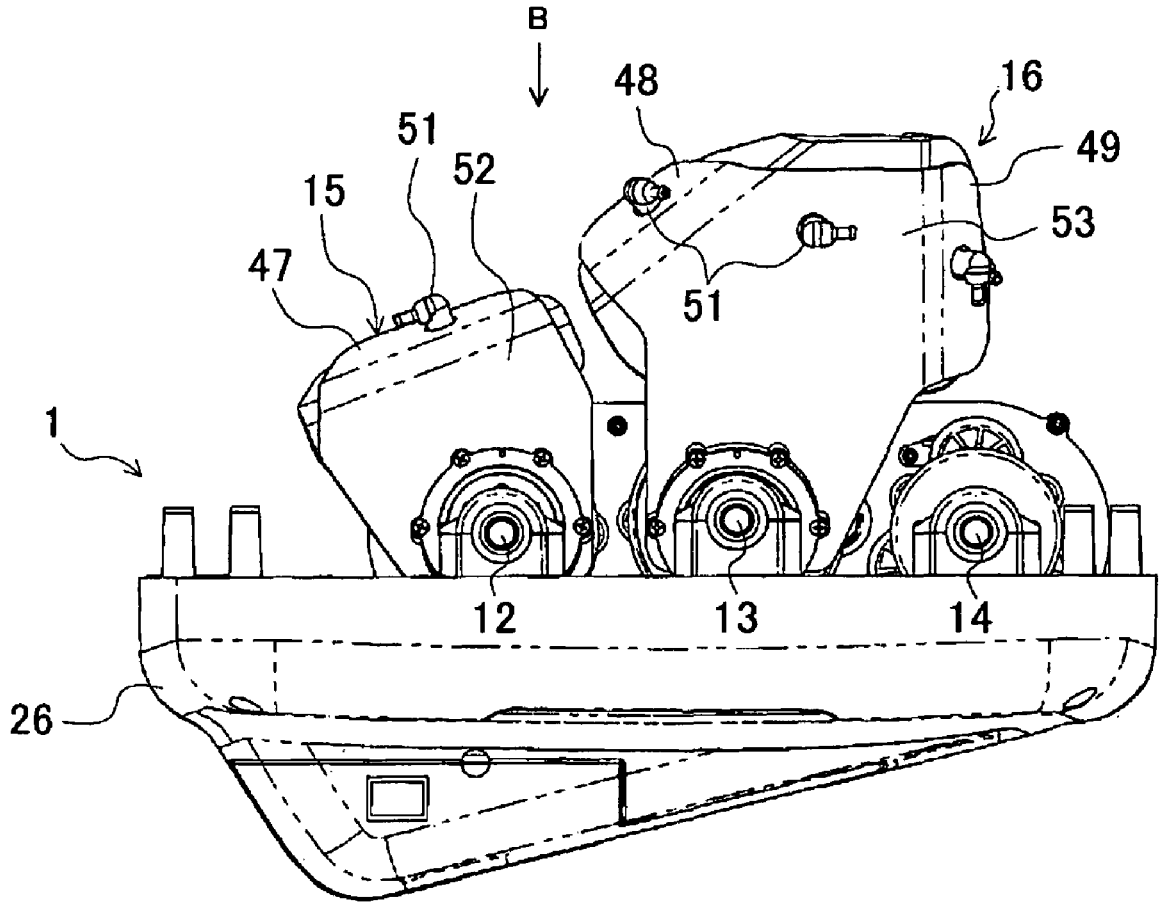
FIG. 2 is a side view of FIG. 1 observed from direction A.

FIGS. 1-10 are schematic views according to the first embodiment of the present invention. Symbol 1 of FIG. 1 represents the massage device. In the massage device 1, rotational driving force of a motor 18 is transmitted to a rotational shaft 19 of worm and helical gears 20, 21, 22 of a driving mechanism 17 to drive driving shafts 12, 13, 14. Rollers 9, 10, and 11 of bottom therapeutic members are disposed on the driving shafts 12, 13, 14, respectively. The rollers 9, 10, and 11 are driven by the driving shafts 12, 13, 14 in a predetermined direction. The bottom of a patient's forefoot, not shown in the figure, can be placed on the roller 9. The roller 10 is disposed at a position corresponding to an arch of a foot of a patient. The roller 11 is disposed at a position corresponding to the heel of the patient. Therapeutic protrusions 6, 7, and 8 are provided on the rollers 9, 10, and 11, for generating higher pressure than the pressure provided by the weight of a patient's foot.

Figure 6:
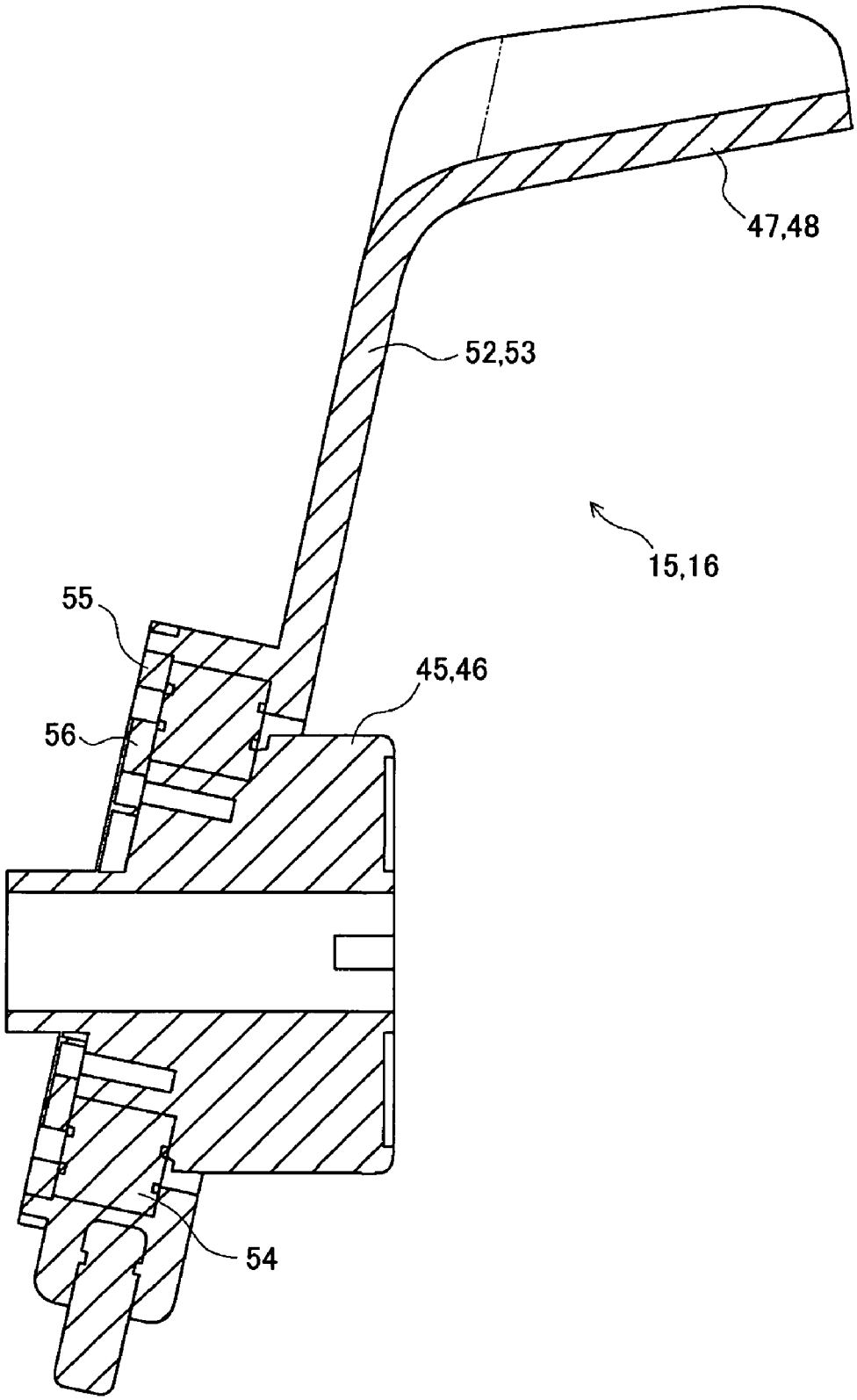
FIG. 6 is a cross section of FIG. 5 taken along line ST-ST.
Figure 7:
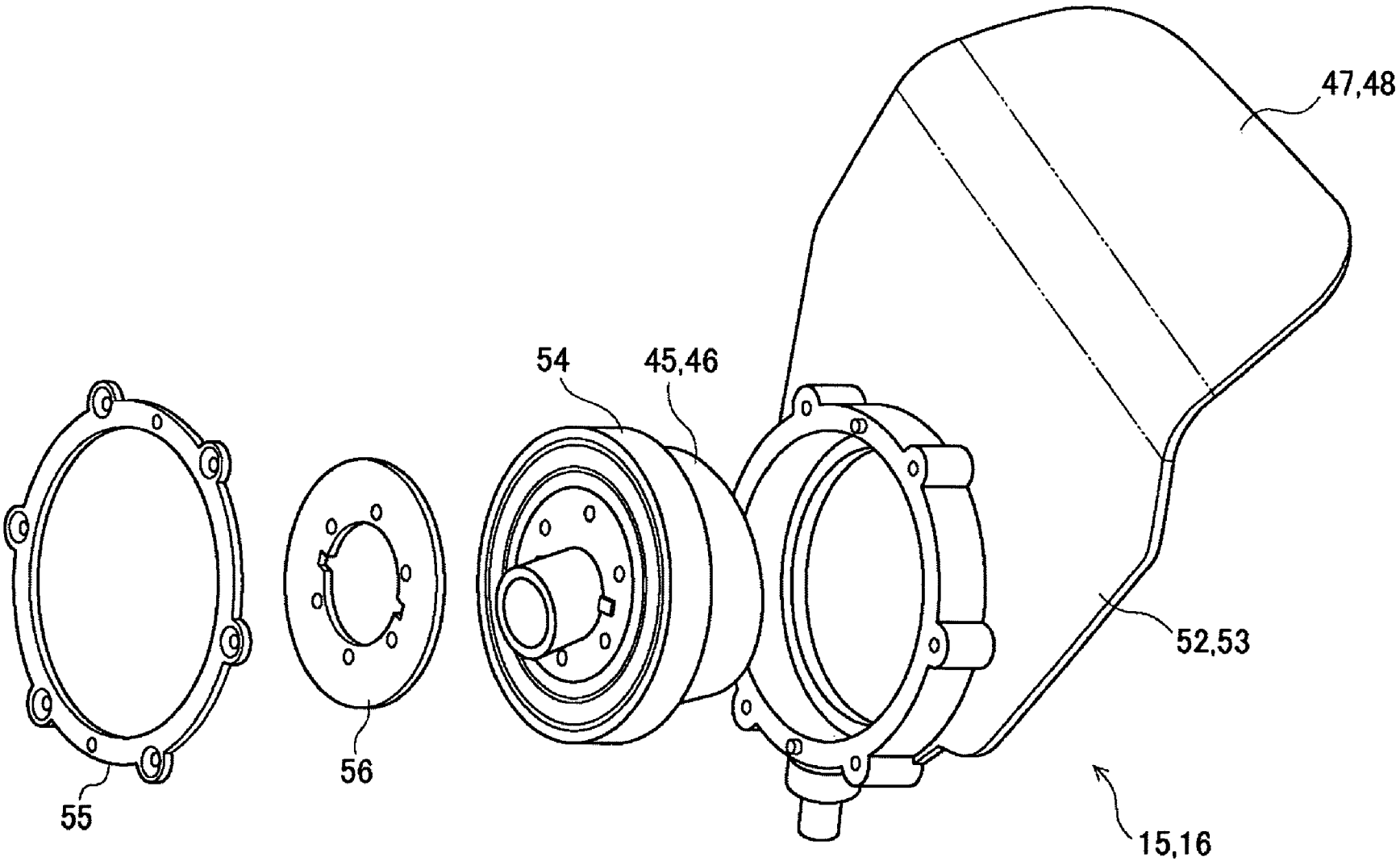
FIG. 7 is an exploded perspective view of the therapeutic element of FIG. 5.

A pair of therapeutic elements 15 and 16 is disposed near the rollers 9, 10, clamping the rollers 9, 10 from the leftward and rightward directions. The therapeutic elements 15 and 16 are designed according to the contour of the rollers 9, 10. By rotating the driving shafts 12, 13, and 14, the therapeutic elements 15 and 16 are moveable between an approaching position of FIG. 6 and a departing position of FIG. 7. In FIG. 7, when the therapeutic elements 15 and 16 are outstretched, feet can be put on the device according to the rollers 9, 10, and 11. As shown in FIG. 6, when a foot is shut therein, the therapeutic elements 15 and 16 clamp to the foot to massage and apply pressure thereon from multiple directions toward three preset locations: the sole of forefoot, the arch of the foot and the heel. The rollers 9, 10, and 11 and the therapeutic elements 15 and 16 are symmetrically and respectively disposed on left and right sides with a certain interval therebetween, and capable of massaging both feet simultaneously.

Figure 5:
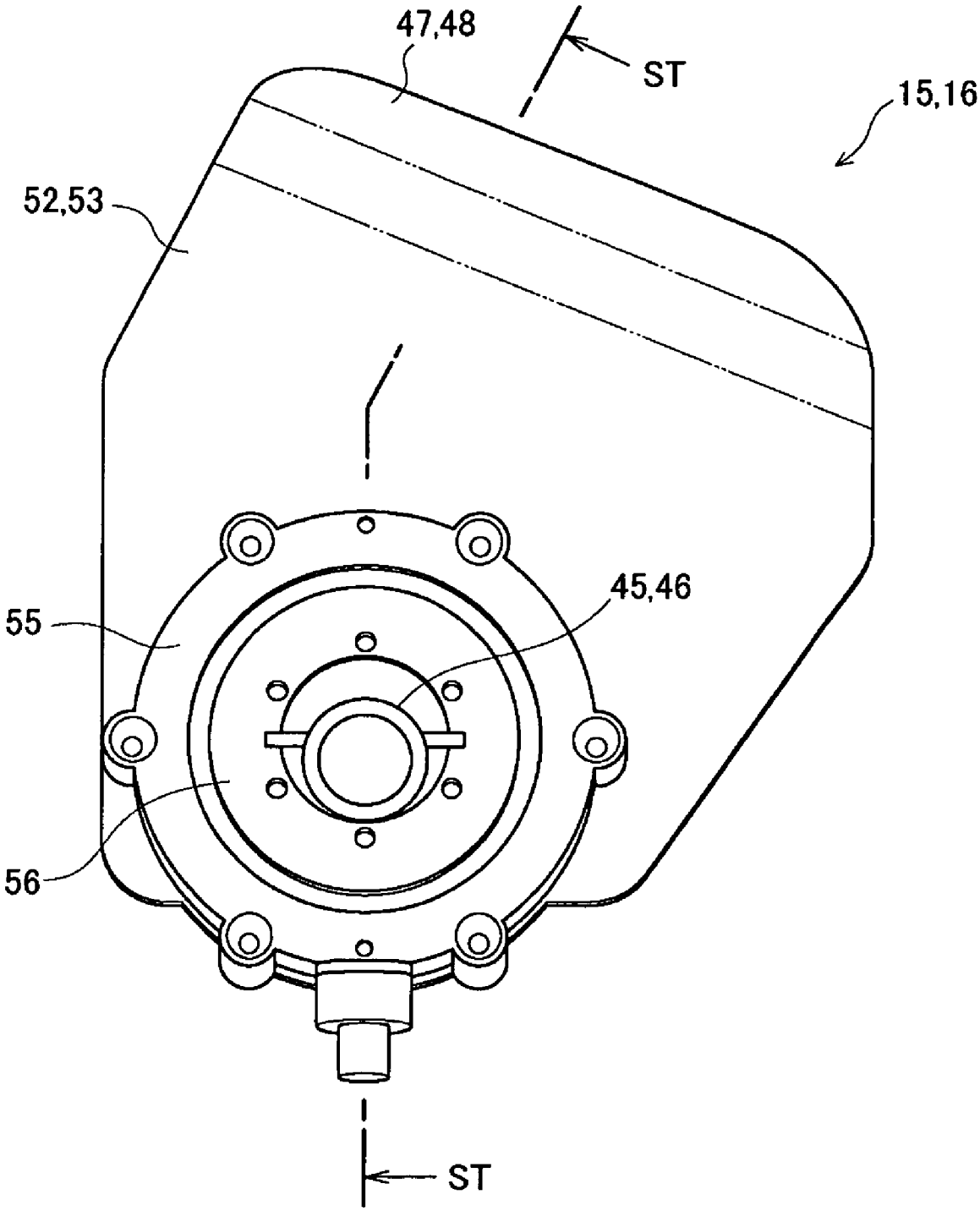
FIG. 5 is a front view of the therapeutic elements of FIG. 1.

As shown in FIGS. 5-7, the therapeutic elements 15 and 16 include massaging bases 45, 46, massaging plates 52, 53, and pressure boards 47, 48. The symmetric massaging bases 45 and 46 are fixed in rotational and axial directions of the driving shafts 12, 13. On the outer periphery of the massaging bases 45 and 46, the massaging plates 52 and 53 are inserted at an angle with respect to the driving shafts 12, 13 and fixed by a bearing 54 in an axial direction. The pressure boards 47 and 48 are formed on the top end of the massaging plates 52 and 53. Furthermore, to reach the foot and massage the forefoot instep of the patient M, the pressure boards 47, 48 and the massaging plates 52, 53 form a roughly L-shaped cross section. A guiding portion 49 corresponding to the side of the forefoot with a certain degree of flexibility is formed according to the contour of a forefoot. A flexible member 50 is formed on the opposite side of the pressure boards 47, 48, and the side of the patient's foot. An expandable airbag, not shown in the figure, is disposed between the pair of pressure boards 47, 48 and the flexible member 50. An air supply source on the airbag has a pipe 51 for discharging air. It is possible that the pressure level may become excessive; hence, the pipe is provided with a mechanical valve for safety. Additionally, Symbol 55 represents a pressure board of the bearing 54. Symbol 56 represents a pressure board for holding the massaging plates 52, 53 on the massaging base 45, 46.

Figure 8:
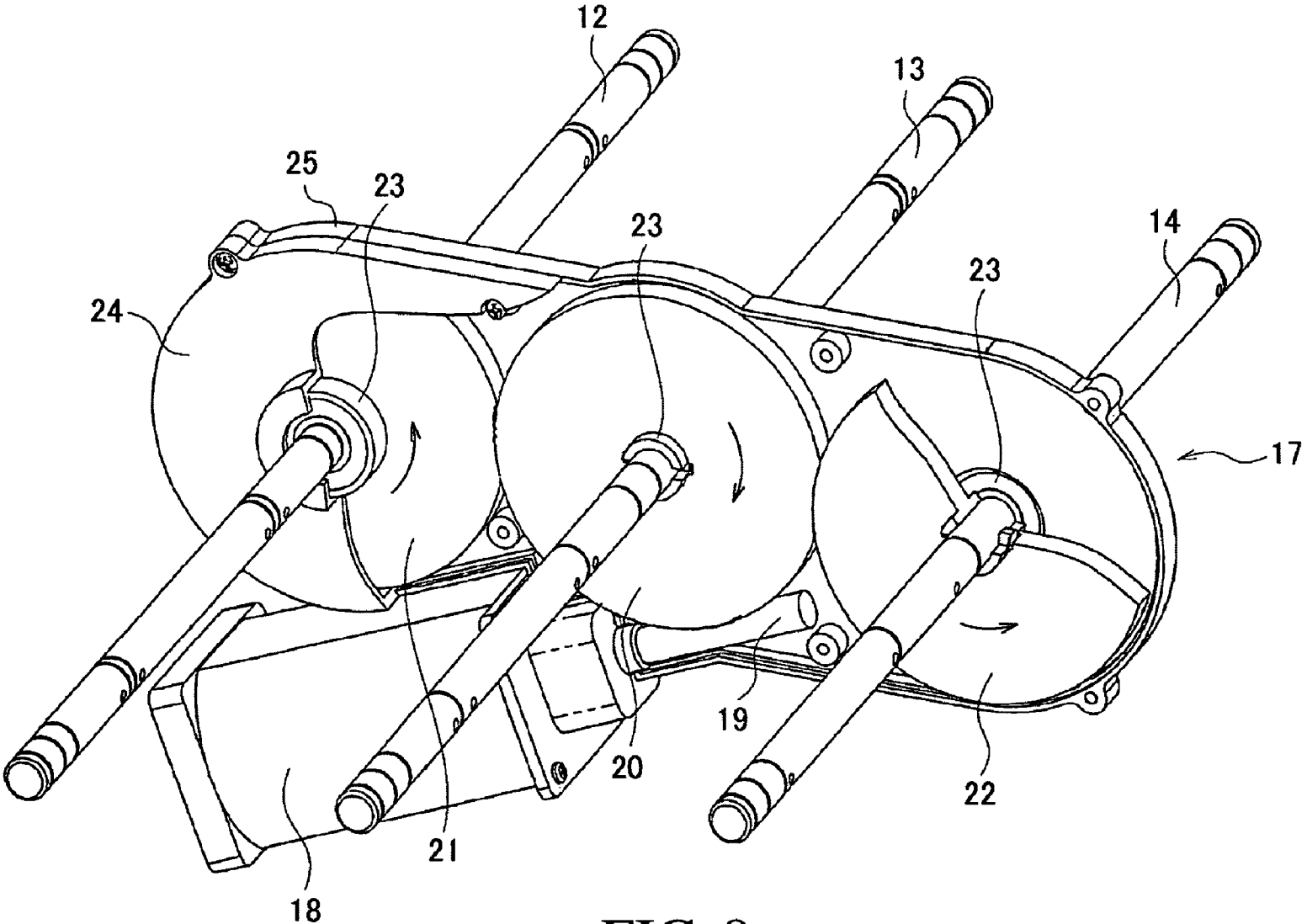
FIG. 8 is a perspective view of the driving mechanism.

In FIG. 8, the driving mechanism 17 is formed by a worm gear on the rotational shaft 19 of the motor 18, fixed on the gear case (not shown). The motor 18 is meshed with the helical gear 20 on the worm of the rotational shaft 19, for decelerating rotational speed. The deceleration can be achieved by any means. By meshing with the helical gear 20, the helical gears 21, 22 with the same reduction gear ratio face the helical gear 20, which is the intended location for the foot arch. As a result, the helical gears 21 and 22 are disposed facing the sole of the forefoot and the heel, respectively. Furthermore, the helical gear 20 is located higher than the axes of the helical gears 21, 22 and disposed in the vicinity of the therapeutic elements 15 and 16. The helical gear 20 is turned in a direction opposite to the rotational direction of the helical gears 21, 22 by a suitable tool. The helical gears 20, 21, and 22 are supported by the bearing 23 for free rotation and fixed on the center of the driving shafts 12, 13, and 14 passing through the gear case 23 and 25 in rotational and axial directions. Thus, each helical gear is rotated accordingly. Symbol 26 is a container for receiving the motor 18.

Each driving shaft 12, 13, or 14 is disposed across the gear case with an adequate interval therebetween, which is roughly equivalent to a shoulders width when feet are placed naturally thereon. The rollers 9, 10, and 11 and the driving shafts 12, 13, and 14 are fixed in the same rotational and axial direction. The rollers 9, 10, and 11 are rotated with the driving shafts 12, 13, 14. The roller 9 and roller 10 are the closest rollers. Compared to the rotational direction of the roller 9 toward the front side, the roller 10 rotates to the back side, in an opposite direction. Thus, the therapeutic protrusions 6, 7, and 8 on the surface of the rollers 9, 10, and 11 are freely rotatable with respect to the rollers 9, 10, and 11.

The rotational shafts 12, 14 of the rollers 9, 11 shown in FIG. 8 are disposed on the same level, facing the position intended to support the patient's foot arch. The protrusion 7 on the roller 10 for the foot arch has a locus closer to the foot arch than the locus of the protrusion 6 on the other rollers 9 and 11 intended to face the sole of the foot, and thus, the rotational shafts 12, 14 support the rotational shaft 13 in the above manner.

Figure 9:
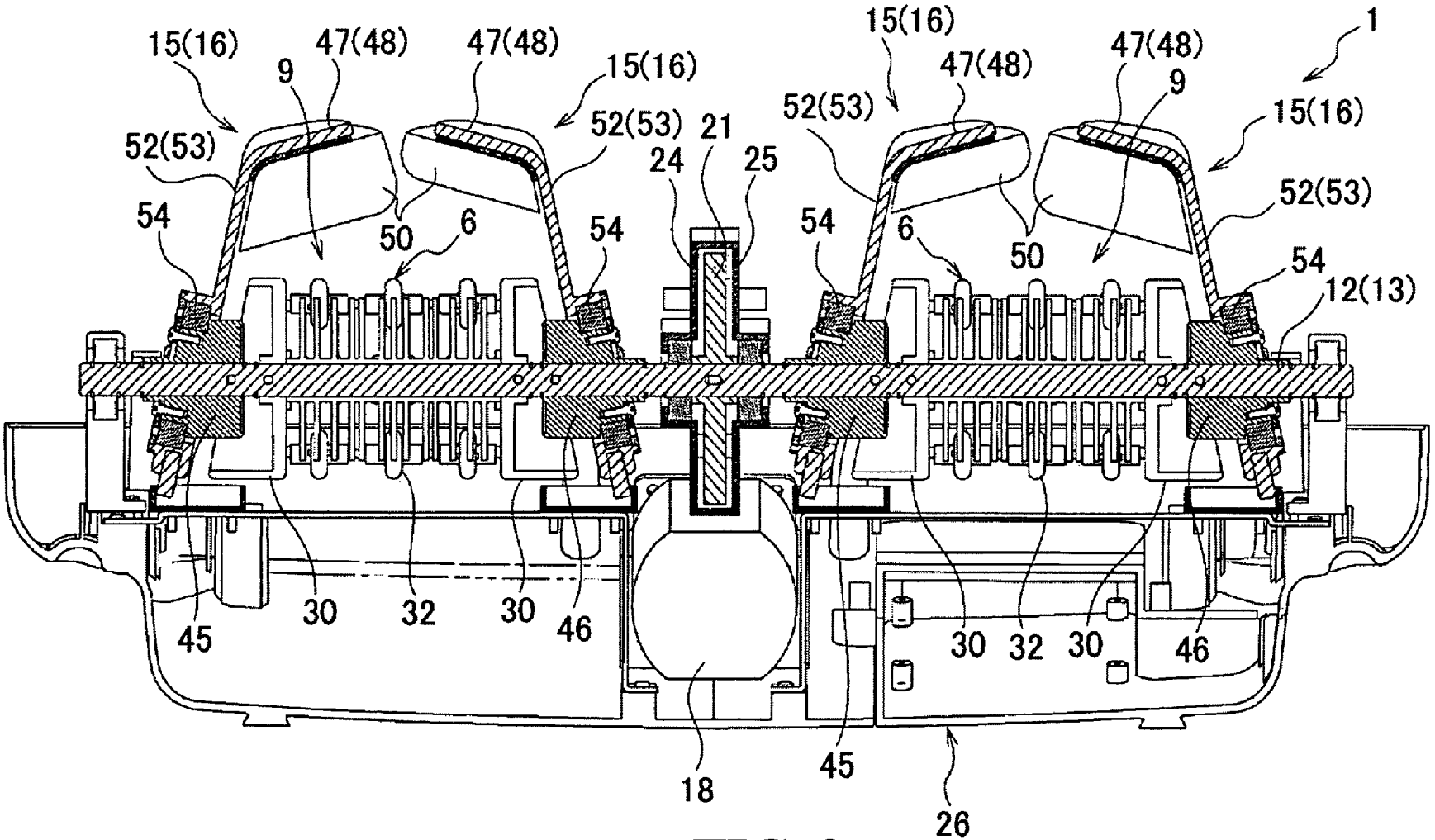
FIG. 9 is a cross section of FIG. 3 taken along line SA-SA.
Figure 10:
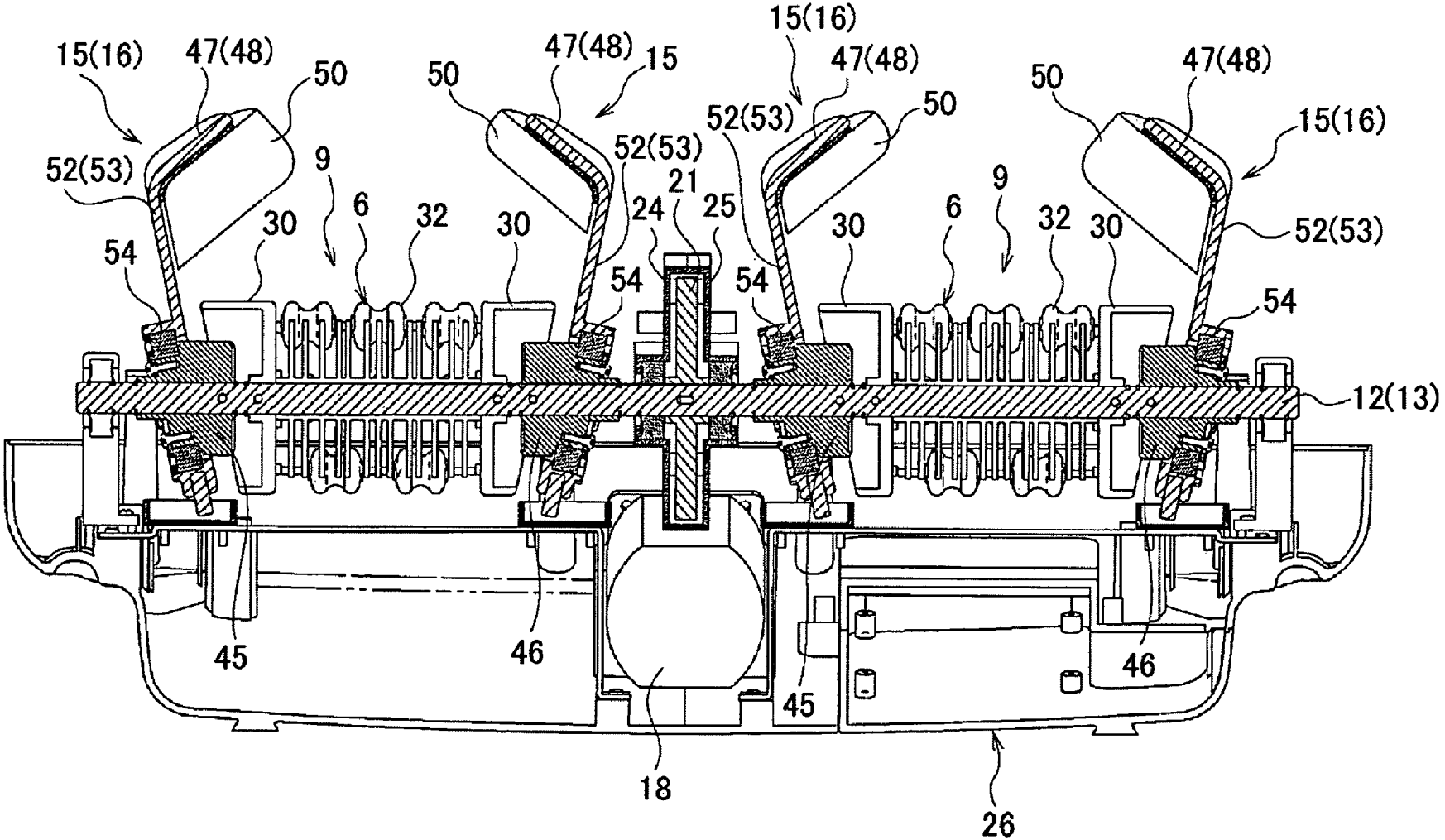
FIG. 10 is a schematic cross section of FIG. 9 when the therapeutic elements are in an open position.

The rollers 9, 10, and 11 have mainly the same structure. Thus, the structure of the roller 9 is given as an example in the following explanation. The roller 9, as shown in FIGS. 9 and 10, comprises six symmetrical protrusions 6, freely supported between two cylindrical bodies 30 and 30, which are symmetrical and disposed on left and right sides, respectively. The six protrusions 6 are freely and respectively supported by six rods disposed between the bodies 30 and 30.

The operation and structure according to the first embodiment of the present invention is described in the following:

When placed in the three intended portions of the sole, arch and heel, the rollers 9, 10, and 11 having protrusions 6, 7, and 8 generate higher pressure than can be exerted by the weight of a typical foot placed thereon, and thus, the sole of the foot can be effectively stimulated, particularly in the three mentioned locations, in a short period of time. Additionally, the therapeutic elements 15 and 16 are disposed along the instep of a foot, and thus, even if load is increased on the sole of the foot, which is the intended target portion for stimulation, the therapeutic elements 15 and 16 can prevent the foot from slipping off the device. As a result, effective stimulation on the foot sole can be achieved. Moreover, at least two therapeutic elements 15 and 16 are disposed in the longitudinal direction of a foot. Thus, the therapeutic elements 15 and 16 can provide an effective and wide range of foot massage according to shape.

The adjacent rollers 9, 10 and 10, 11 can potentially rotate in opposite directions, and thus the feet are moved by the rollers 9, 10, and 11, providing smooth foot massage.

A flexible member 50 is disposed on a side of the therapeutic elements 15 and 16 facing the foot arch with a therapeutic protrusion thereon for providing pressure on the patient's instep from above, and thus, when the foot is pressed from above by the flexible member 50, the foot can be prevented from slipping off the massage device by the flexible member 50, thus, effectively stimulating the foot sole.

The therapeutic protrusions 6, 7, and 8 of the rollers 9, 10, and 11 are disposed on the outer surface thereof and rotatably supported by the driving shafts 12, 13, 14, facing the rollers 9, 10, and 11. Thus, the friction between the foot sole and the rollers 9, 10, and 11 is reduced, preventing movement of the foot. Namely, the foot is more easily massaged. Moreover, the driving shaft 13 of the roller 10 facing the foot arch is disposed higher than the other rollers 9, 11, thus, providing better stimulation on the foot arch.

The massaging bases 45 and 46 are rotated by the driving shafts 12 and 13. The angle at which the bearing 54 is inserted in the massaging bases 45 and 46 is varied with the rotational angle. The massaging plates 52 and 53 are disposed on the bearing 54 at the same angle as the slanting angle of the massaging bases 45 and 46. The massaging plates 52 and 53, however, are disposed in the opposite direction, approaching the opposite side, such that the foot M can be placed in the space therebetween for massage. Additionally, since the pressure boards 47 and 48 are formed corresponding to the foot or covering the instep, and when the pressure boards 47 and 48 approach, the foot arch is firmly pressed downward by the pressure boards 47 and 48.

Since the flexible member 50 is an airbag, the flexible member 50 corresponds to the shape and size of each foot, providing supported at a constant pressure. Additionally, the distance between the therapeutic elements 15 and 16 can be reduced regardless of the restriction in the different foot sizes when the airbag is expanded. Thus, the foot is massaged with an adequate strength. Additionally, when the pressure of the airbag is higher than a certain pressure, excess compressed air is discharged by the mechanical valve for safety, suppressing over strong stimulation of the therapeutic parts and increasing durability of the airbag.

Figure 3:
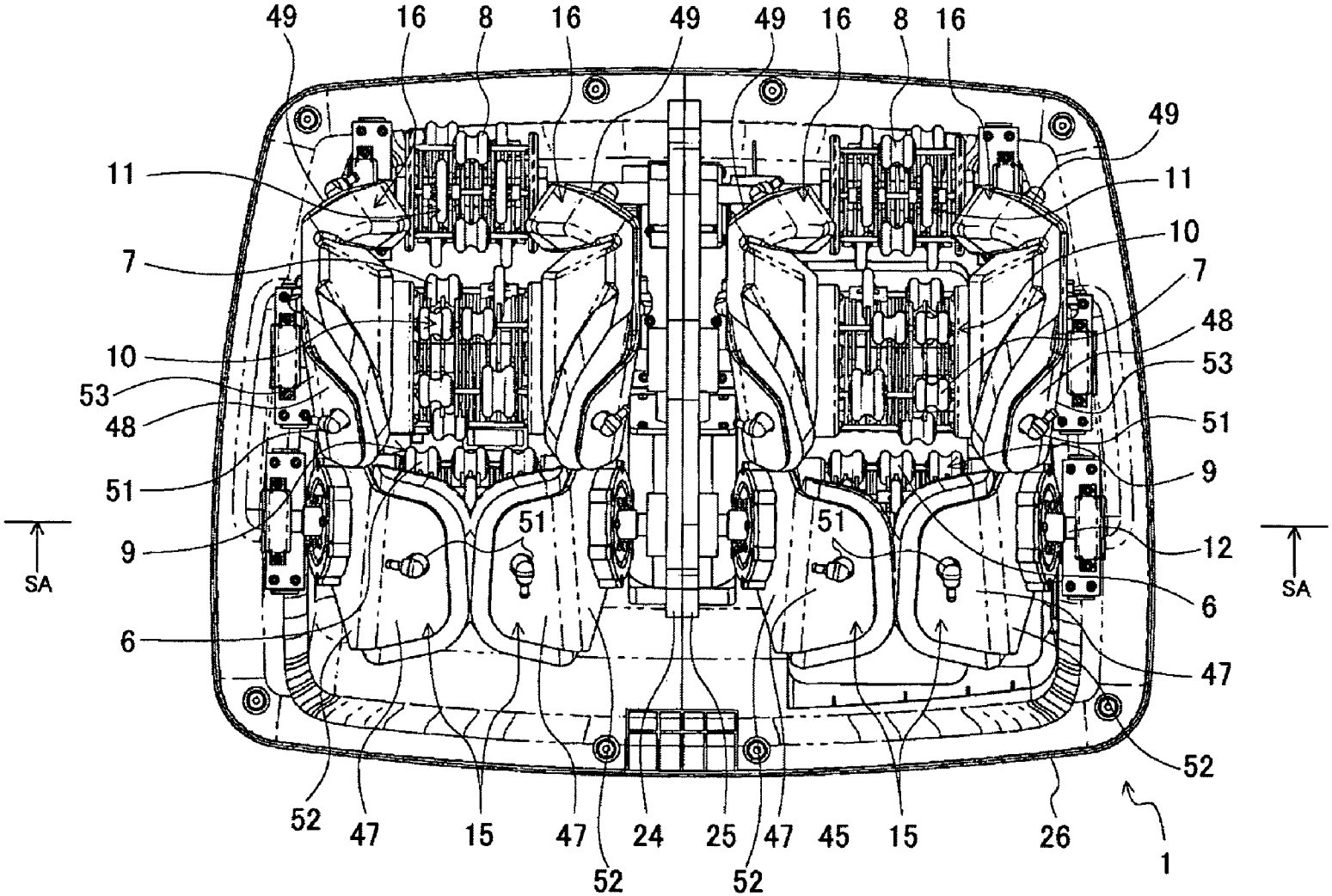
FIG. 3 is a top view of FIG. 2 observed from direction B.
Figure 4:
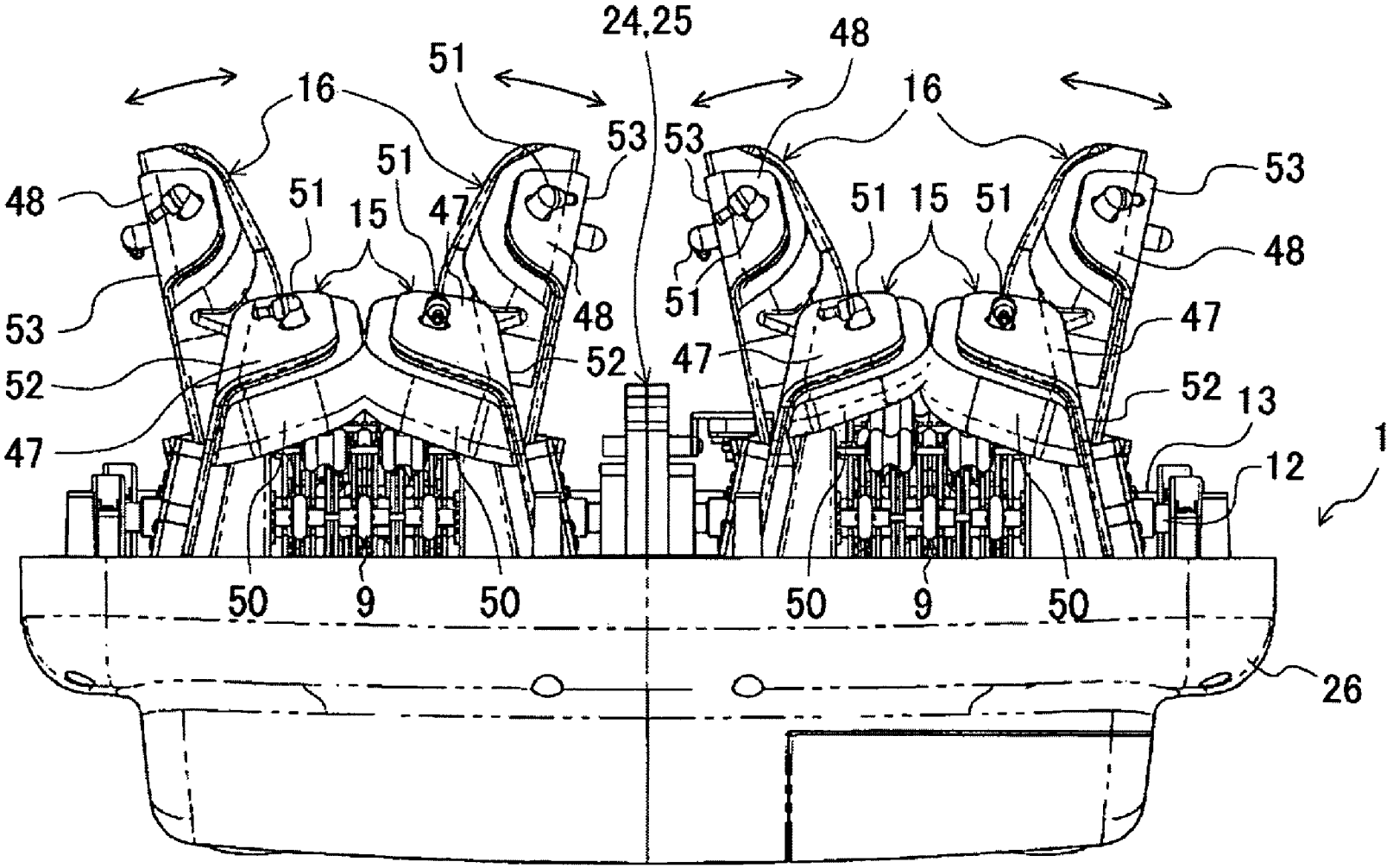
FIG. 4 is a front view of FIG. 1 observed from direction C.
Figure 11:
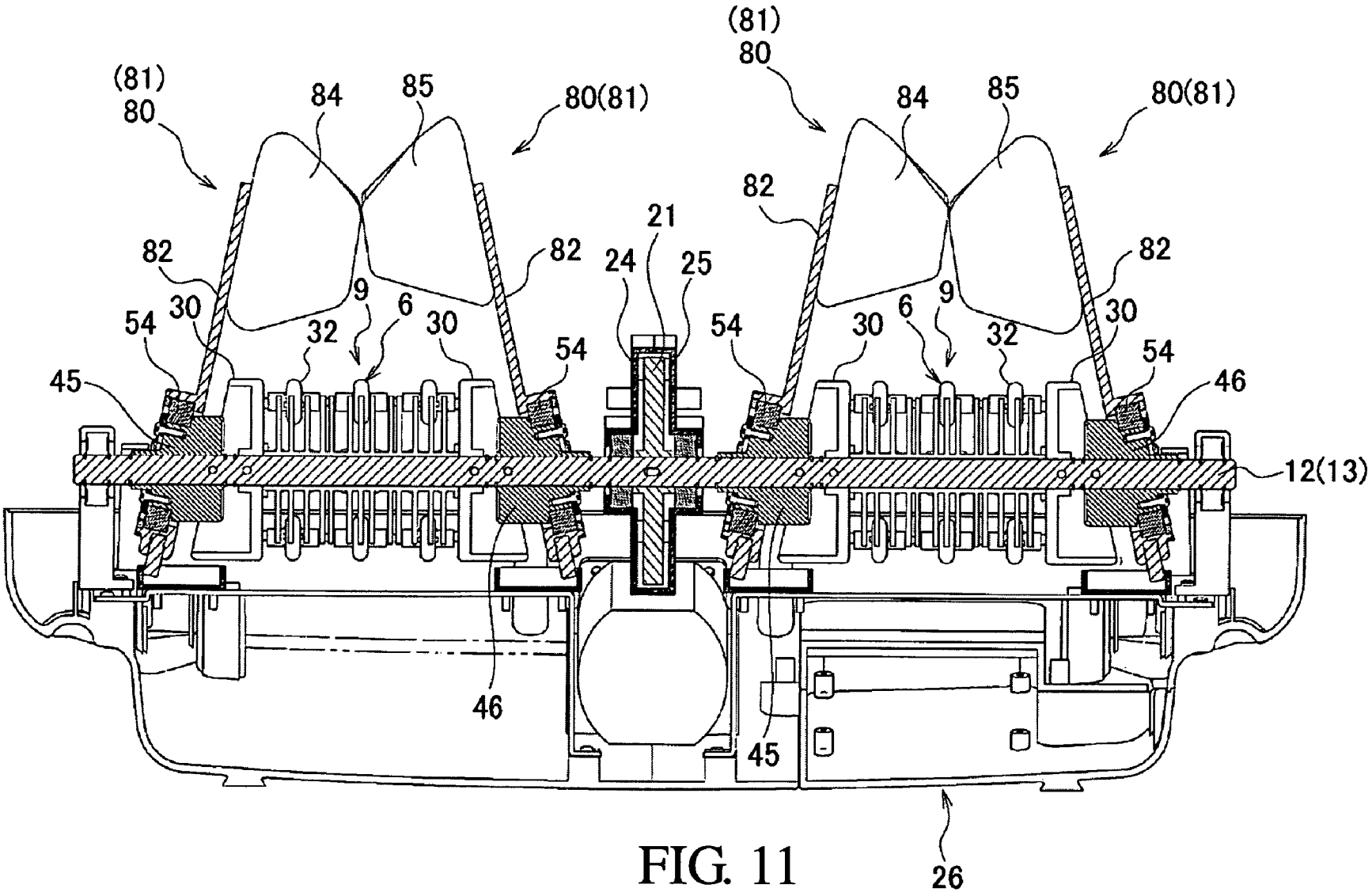
FIG. 11 is a cross section equivalent to FIG. 9 of the second embodiment according to the present invention.
Figure 12:
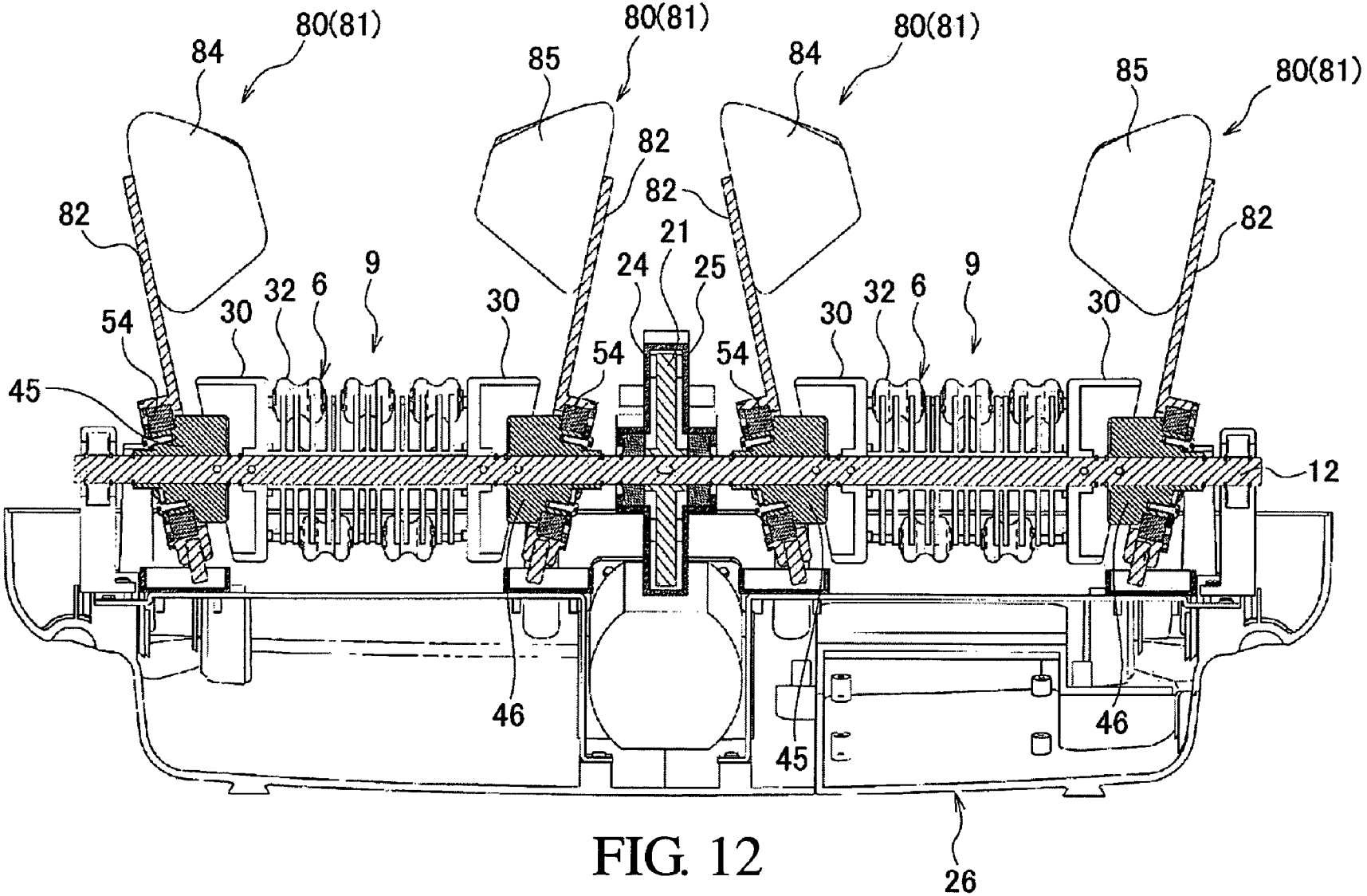
FIG. 12 is a schematic cross section of FIG. 10 when the therapeutic elements are in an open position.

FIGS. 11 and 12 are schematic views according to the second embodiment of the present invention. Symbols 80 and 81 in FIGS. 11 and 12 are substitutes for therapeutic elements 15 and 16. The therapeutic elements 80 and 81 include massaging bases 45 and 46, massaging plates 82, and pressing blocks 84 and 85. The flat massaging bases 45 and 46 are fixed symmetrically on left and right sides, and rotated axially with respect to the driving shafts 12 and 13. On the outer periphery of each massaging base 45 and 46, a massaging plate 82 is fixed axially by a bearing 54 and inserted at an angle with respect to the driving shafts 12 and 13. Each pressing block 84 or 85 is disposed on an opposite side of the top end of each massaging plate 82. Each pressing block 84, 85 and the massaging plate 82 form an L-shaped cross section for massaging the instep of the forefoot. The guiding portion 49 having adequate flexibility, as shown in FIGS. 1 and 3, is formed according to the shape of a foot. As a result, by providing firm pressure on instep, the sole of the foot can be thoroughly massaged.

Figure 13:
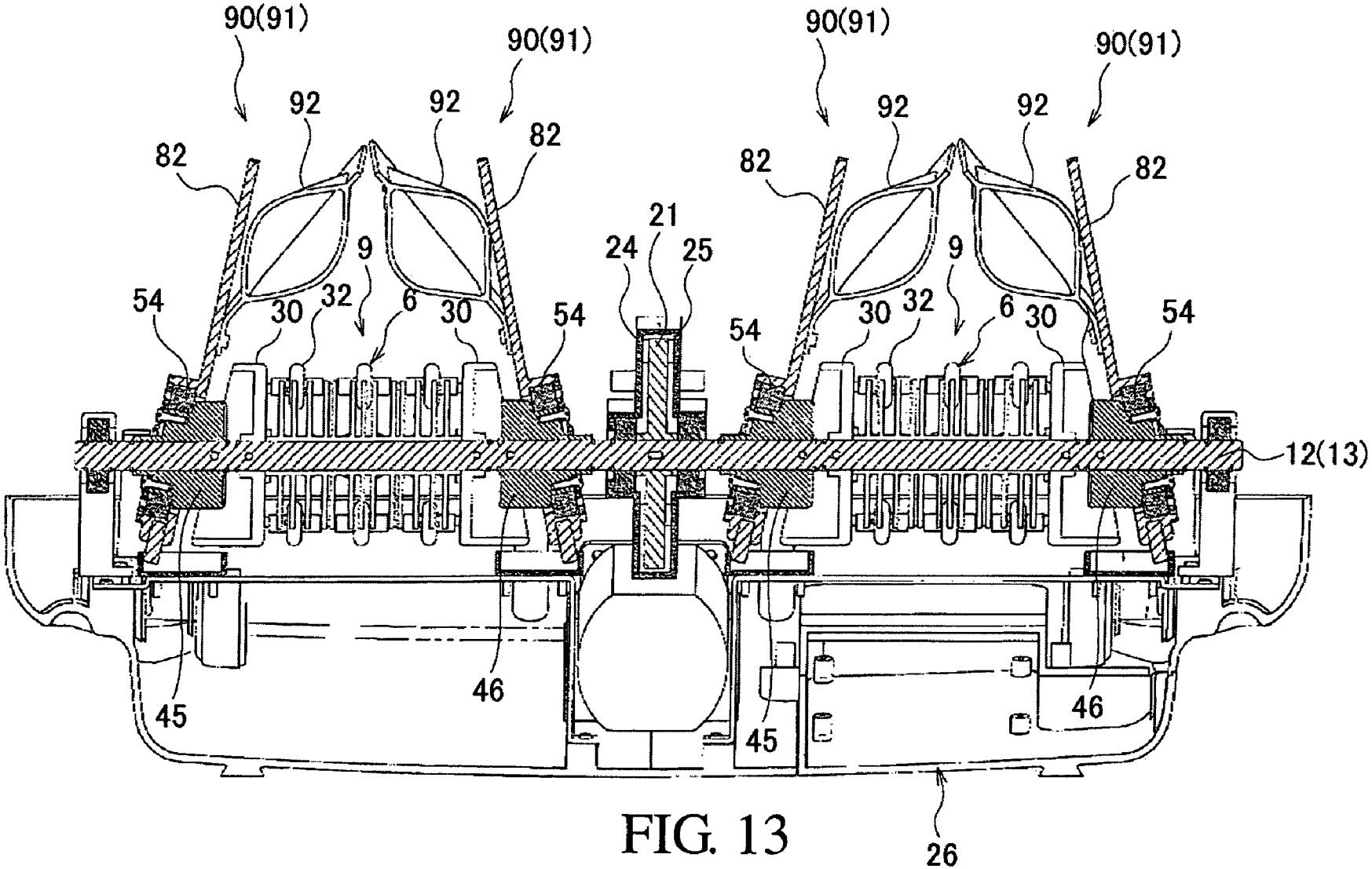
FIG. 13 is a cross section equivalent to FIG. 9 of the third embodiment according to the present invention.
Figure 14:
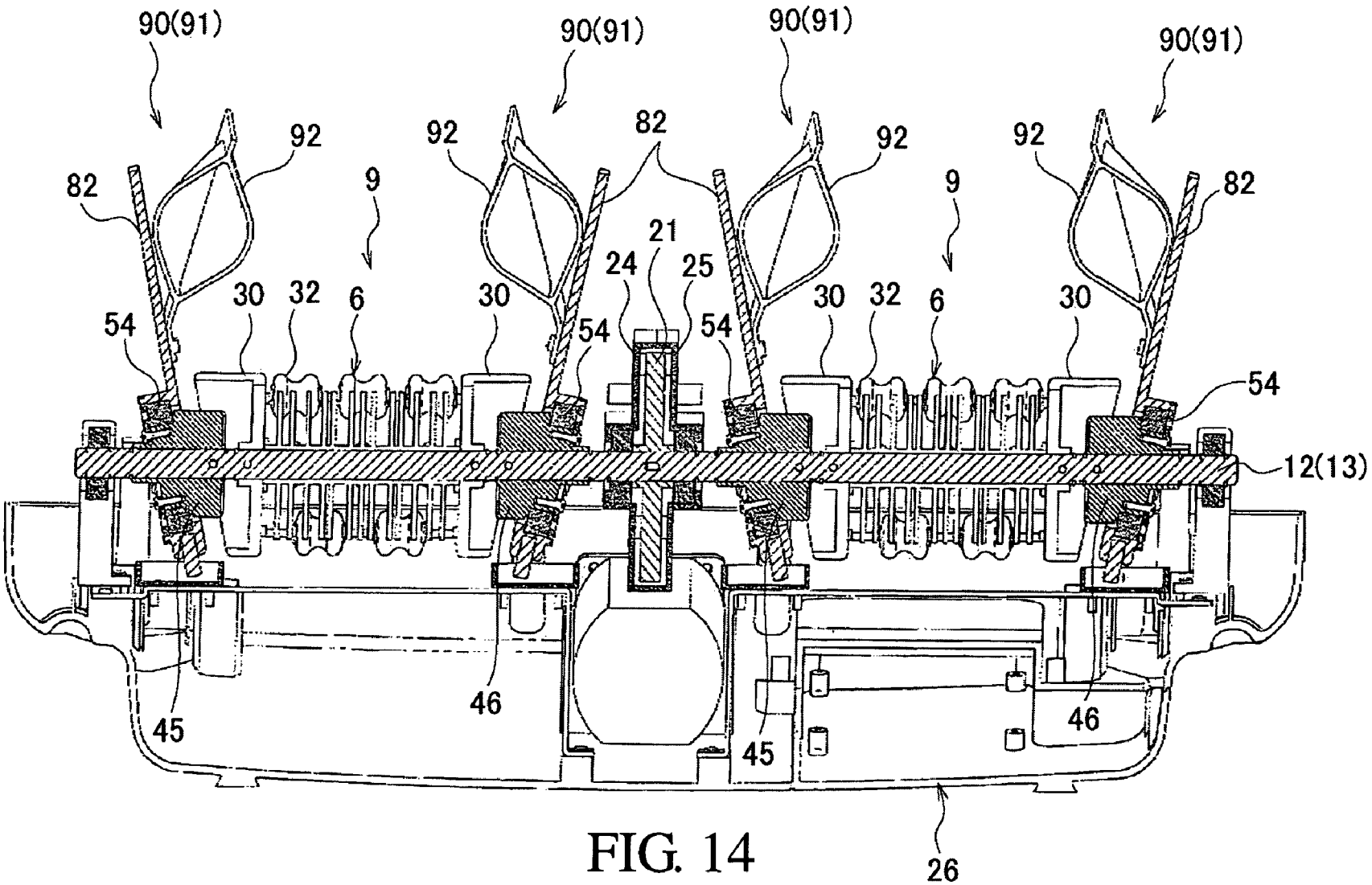
FIG. 14 is a schematic cross section of FIG. 13 when the therapeutic elements are in an open position.

FIGS. 13 and 14 are schematic views according to the third embodiment of the present invention. Symbols 90 and 91 in FIGS. 13 and 14 are substitutes for therapeutic elements 15 and 16. The therapeutic elements 80 and 81 include massaging bases 45 and 46, massaging plates 82, and pressing blocks 92. The flat massaging bases 45 and 46 are fixed symmetrically on left and right sides, and rotated axially with respect to the driving shafts 12 and 13. On the outer periphery of each massaging bases 45 and 46, a massaging plate 82 is fixed axially by a bearing 54 and inserted at an angle with respect to the driving shafts 12 and 13. Each pressing block 92 is disposed on an opposite side of the top end of each massaging plate 82. Each pressing block 92 and the massaging plate 82 form an L-shaped cross section for massaging the instep of the forefoot. The guiding portion 49 having adequate flexibility, as shown in FIGS. 1 and 3, is formed according to the shape of the foot. As a result, by securely pressing the patient's instep, the foot sole can be massaged thoroughly.

Figure 15:
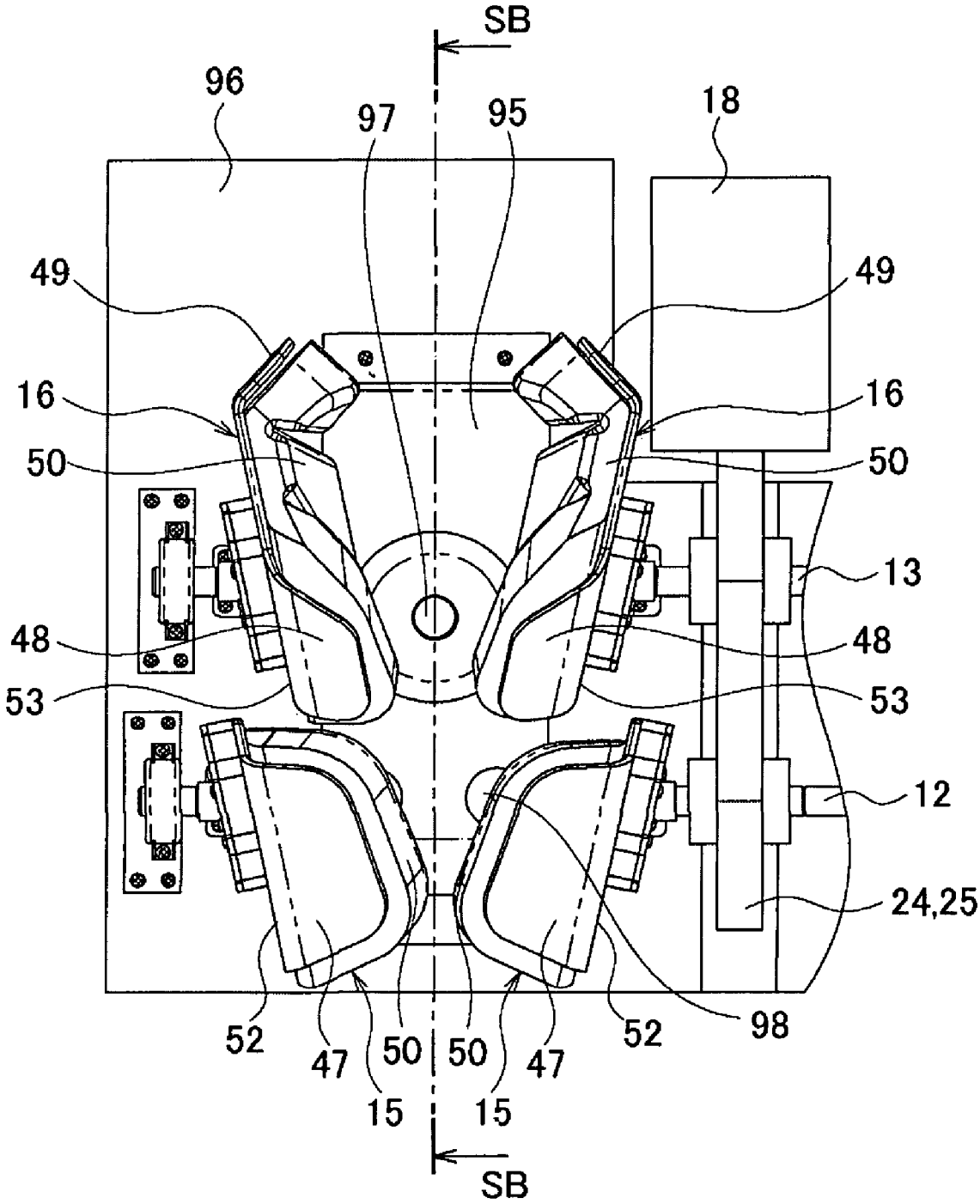
FIG. 15 is a front view equivalent to FIG. 3 of the fourth embodiment according to the present invention.
Figure 16:
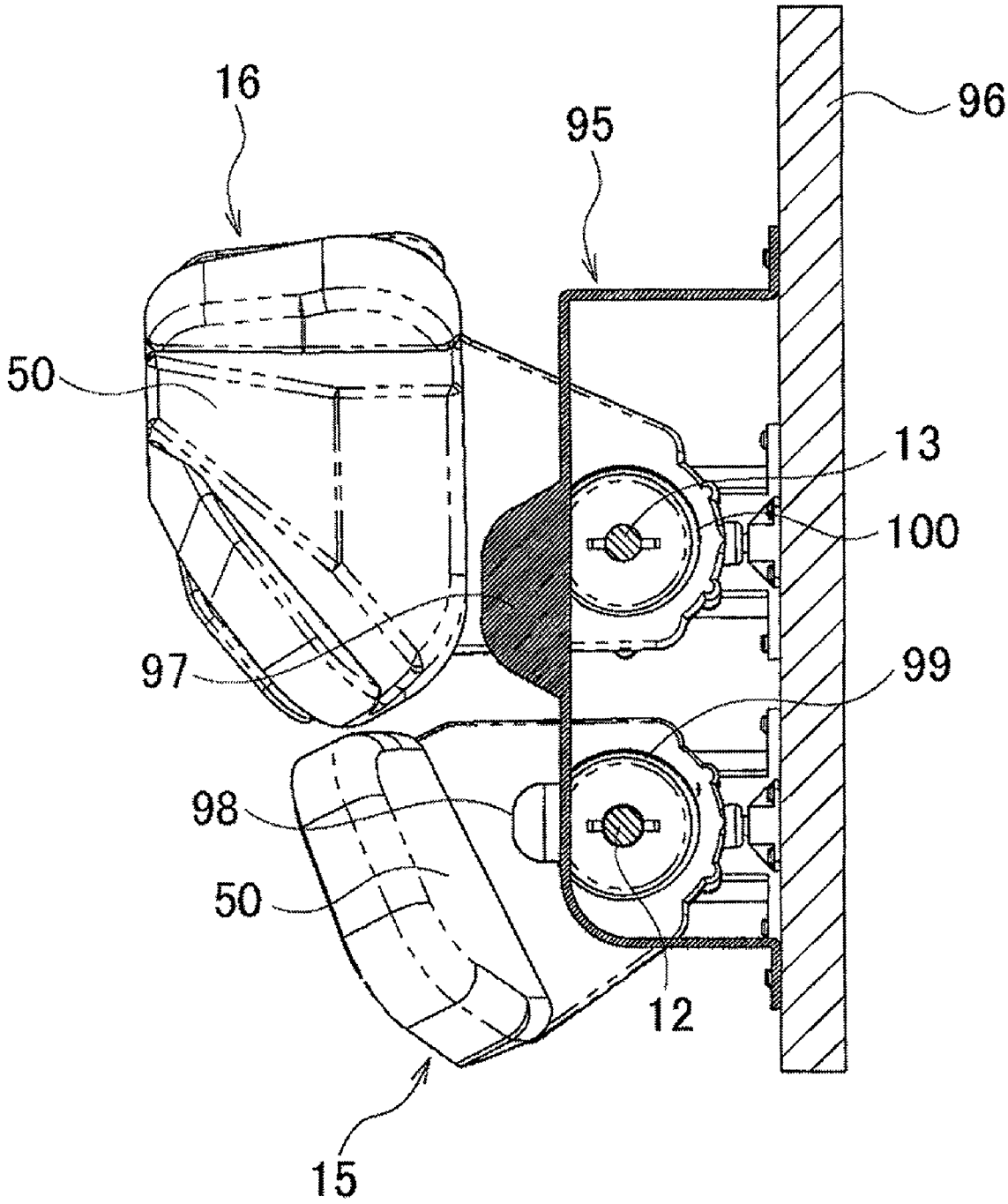
FIG. 16 is a cross section of FIG. 15 taken along line SB-SB.

FIGS. 15 and 16 are schematic views according to the fourth embodiment of the present invention. A seat 95 is disposed on the base 96. The bottom therapeutic members 97 and 98 protrude not only out of the seat 95 but also have protrusions thereon facing the sole of the foot. The reflex points in the sole and arch of the forefoot are rotatably pressed by the rollers 99, 100. By applying adequate pressure thereon, the foot can be thoroughly and smoothly massaged.

Figure 17:
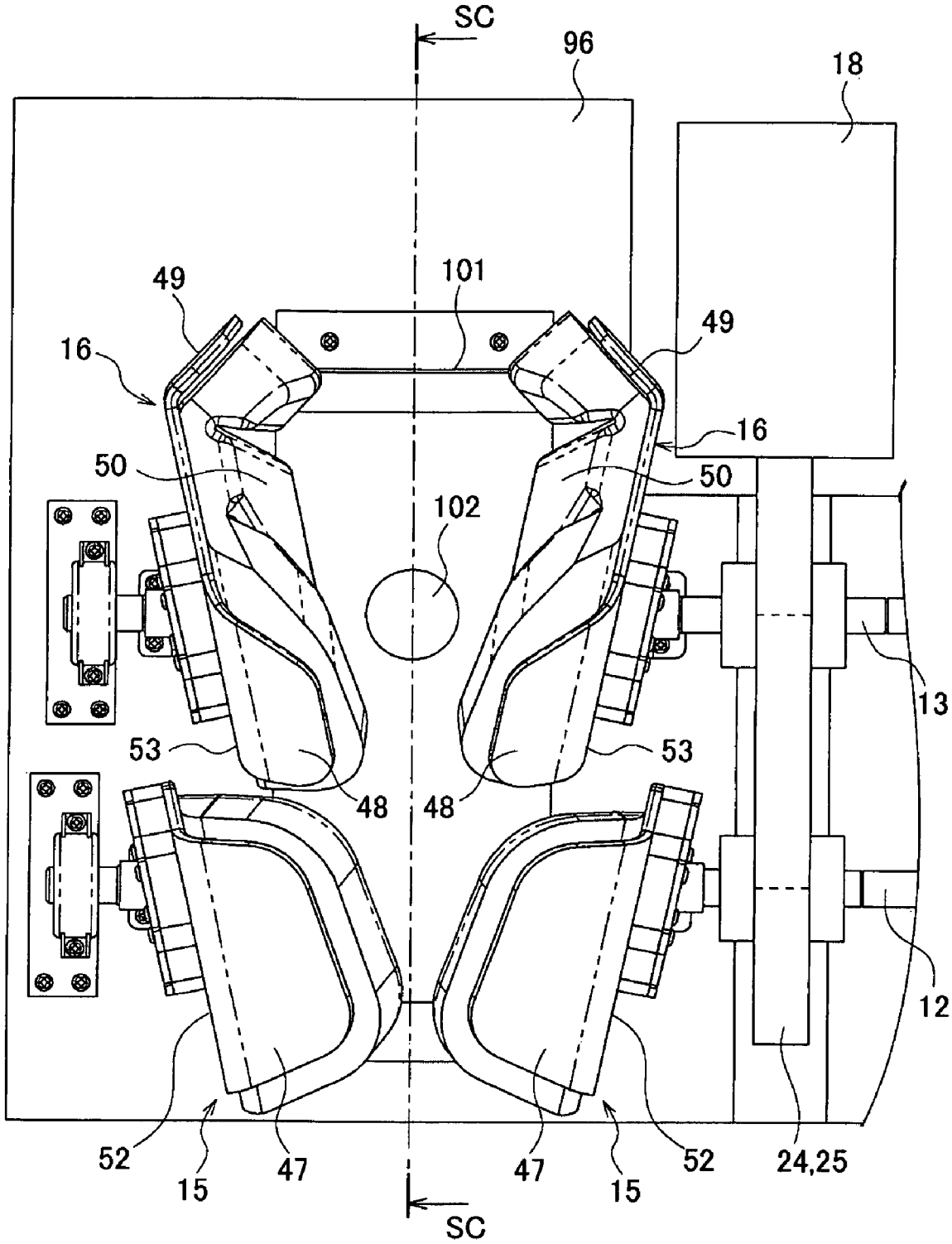
FIG. 17 is a front view equivalent to FIG. 3 of the fifth embodiment according to the present invention.
Figure 18:
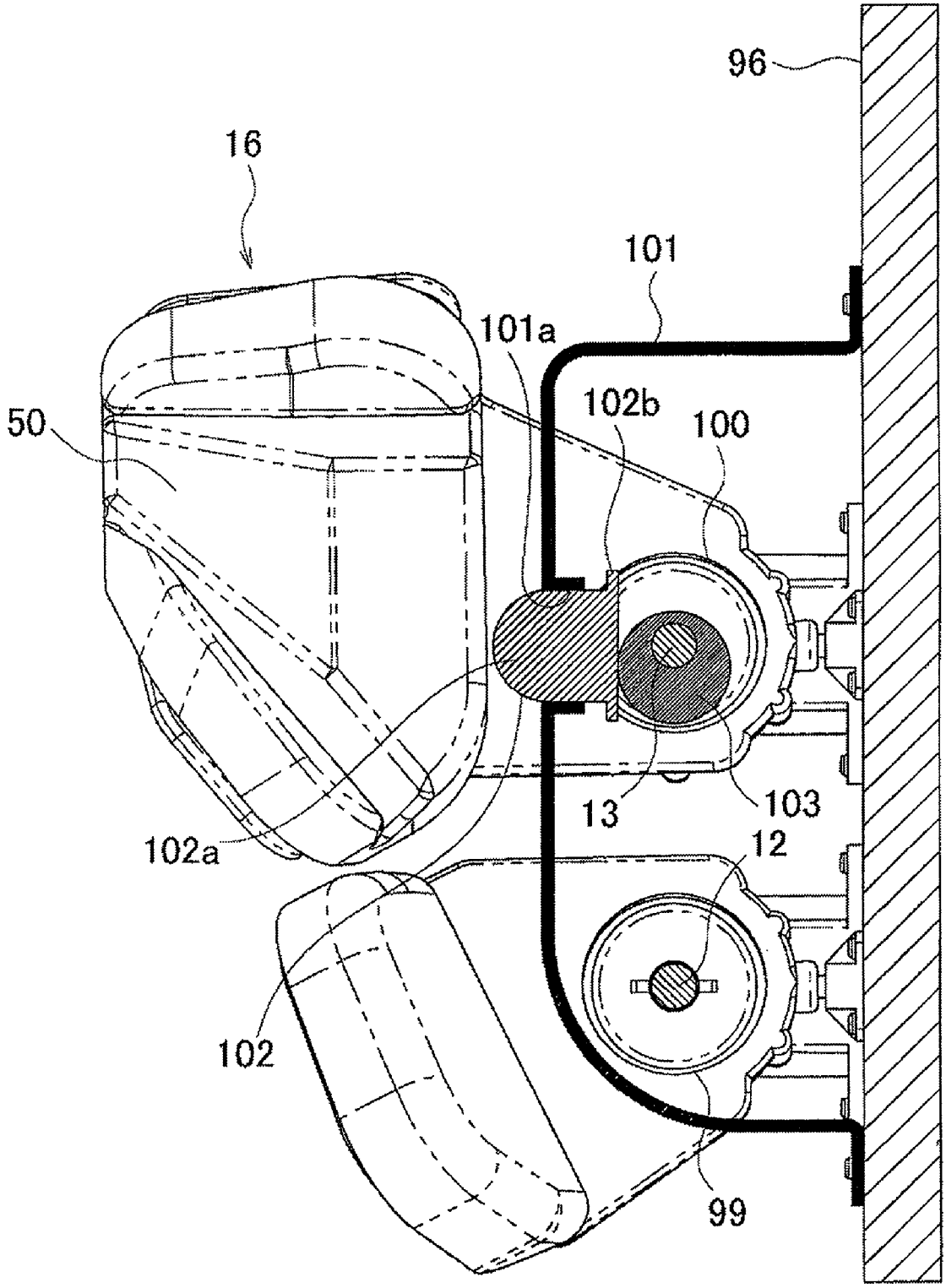
FIG. 18 is a cross section of FIG. 17 taken along line SC-SC.

FIGS. 17 and 18 are schematic views according to the fifth embodiment of the present invention. Symbol 101 in FIGS. 17 and 18 is a seat disposed on the base 96. The seat 101 has a thru-hole 101 a formed thereon. The cylindrical bottom therapeutic member 102 is freely movable in the thru-hole 101*a* between a protruding position and a hidden position. The top of the bottom therapeutic member 102 is spherical, and the base portion 102*b* is pushed and pulled by an eccentric portion 103, disposed on the driving shaft 13. The head 102*a* of the bottom therapeutic member 102 protrudes and submerges with respect to the sole of the foot. Thus, the massage device provides effective stimulation particularly on the foot arch.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A massage device, comprising:

a driving shaft;

a driving mechanism;

a pair of therapeutic elements, rotated by the driving shaft, driven by the driving mechanism, for supporting and massaging feet, wherein each therapeutic element comprises a pressure board and a massage plate and the massage plate and pressure board form a substantially L-shaped cross-section; and a bottom therapeutic member, disposed between the pair of therapeutic elements, supporting a sole of foot; wherein the pressure board is formed on a top end of the massage plate and including a protrusion covering an upper surface of an instep of a foot such that the instep is firmly pressed downwardly from above by the protrusion, thereby preventing the foot float up from the massage device, thus effectively stimulating the foot sole.

2. The massage device as claimed in claim 1, wherein the bottom therapeutic member supports an instep of foot, and has a roller, having a therapeutic protrusion facing the sole of a foot.

3. The massage device as claimed in claim 2, wherein at least two of the therapeutic elements are disposed along the longitudinal direction of the foot.

4. The massage device as claimed in claim 1, wherein the protrusion is disposed on a side of the therapeutic elements, and faces an instep side of the feet to abut the instep side of the feet from above.

5. The massage device as claimed in claim 1, wherein at least two of the therapeutic elements are disposed along the longitudinal direction of the foot.

* * * * *